US005090255A

United States Patent [19]

Kenney

[11] Patent Number: 5,090,255

[45] Date of Patent: Feb. 25, 1992

[54] PROGRAMMABLE PIPET APPARATUS

[75] Inventor: James W. Kenney, Broomall, Pa.

[73] Assignee: Drummond Scientific Company, Broomall, Pa.

[21] Appl. No.: 500,750

[22] Filed: Mar. 27, 1990

[51] Int. Cl.[5] ..... B01L 3/02

[52] U.S. Cl. ..... 73/1 R

[58] Field of Search ..... 73/863.01, 863.02, 863.32, 73/864.13, 864.16–864.18, 1 R; 422/100; 364/479; 202/1, 14, 23, 71

[56] References Cited

U.S. PATENT DOCUMENTS

| | | | |
|---|---|---|---|
| 3,244,009 | 4/1966 | Tietje et al. . | |
| 3,719,087 | 3/1973 | Thiers . | |
| 3,834,240 | 9/1974 | Kenney . | |
| 3,853,012 | 12/1974 | Scordato et al. . | |
| 3,915,651 | 10/1975 | Nishi . | |
| 3,933,048 | 1/1976 | Scordato . | |
| 3,963,061 | 6/1976 | Kenney . | |
| 4,369,665 | 1/1983 | Citrin . | |
| 4,624,147 | 11/1986 | Kenney . | |
| 4,671,123 | 6/1987 | Magnussen, Jr. et al. . | |
| 4,780,833 | 10/1988 | Atake . | |
| 4,821,586 | 4/1989 | Scordato et al. . | |
| 4,896,270 | 1/1990 | Kalmakis et al. | 73/864.16 |

*Primary Examiner*—Robert Raevis

*Attorney, Agent, or Firm*—John F. A. Earley; John F. A. Earley, III

[57] ABSTRACT

A method of automatically filling a pipet tube with a desired fill of liquid and automatically dispensing desired aliquots of liquid successively into wells in a tray or the like, comprises the steps of providing a syringe having a piston in a cylinder with the top of the cylinder connecrted to the top of a pipet tube by a flexible hose, moving the piston to its home position at the top of its travel in the cylinder and dispensing any liquid from the pipet tube, signalling a controller that the piston is in its home position and recording that information in the memory of the controller, drawing liquid into the pipet tube to a desired fill volume, signalling the controller that the desired fill volume has been reached and recording that fill volume in the memory of the controller, dispensing a desired aliquot of liquid from the pipet tube, signalling the controller that a desired aliquot has been dispensed from the pipet tube and recording the size of the dispensed aliquot in the memory of the controller, automatically dispensing successive aliquots of liquid from the pipet tube, automatically filling the pipet tube to the desired fill volume, and automatically dispensing successive aliquots of liquid from the pipet tube.

2 Claims, 2 Drawing Sheets

PROGRAMMABLE PIPET APPARATUS

BACKGROUND OF THE INVENTION

1. Technical Field

This invention relates to the field of pipet guns for drawing measured amounts of liquid into a pipet tube, and for dispensing measured amounts, or aliquots, of the liquid from the pipet tube, and more particularly concerns a pipet gun apparatus which is programmable to automatically draw in a desired fill volume of liquid into a pipet tube, and to automatically dispense uniform aliquots of the liquid from the pipet tube, as, for example, to dispense successive aliquots of media to feed growing cells in a number of wells in a tray.

2. Related Inventions

This invention is related to the inventions shown in U.S. Pat. No. 4,624,147 which issued on Nov. 25, 1986; U.S. Pat. No. 3,963,061 which issued on June 15, 1976; and U.S. Pat. No. 3,834,240 which issued on Sept. 10, 1974, all of these patents being issued to Drummond Scientific Company, Broomall, Pa., and all of which are incorporated herein by reference.

3. Background of the Prior Art

The present pipet gun apparatus is an improvement over the prior art in that the pipet guns of the prior art are manually operated, or are electrically operated with wires connected to the pipet gun that restrict its flexibility of use and may cause electrical problems. In manual operation, the operator fills the pipet tube manually by pressing an up valve button on the pipet gun to create a suction and draw the liquid into the pipet tube to a desired fill volume which he judges by eye as he watches the liquid rising in the pipet tube which is calibrated with volume markings. Then he takes the pipet gun and the filled pipet tube to a position over a tray of wells containing cells which are to be fed with the liquid, and he then manually depresses the down valve button to insert desired aliquots of liquid into the wells, and he gauges the volume of each aliquot by eye as he watches the top surface of the liquid recede in the pipet tube as the liquid is being dispensed.

It has long been desired to automatically fill the pipet tube to a desired fill volume, and to automatically dispense desired aliquots of uniform volume, so that the operator does not have to concentrate on filling the pipet tube to a desired calibration line which he must judge by eye, and then dispense desired uniform aliquots by watching the top surface of the liquid in the pipet tube as it lowers to successive calibration lines.

Performing this operation manually by eye can become very tedious and can lead to mistakes, especially if the operator is doing this all day.

Various proposals have been made as to how to solve this problem and how to make the procedure of filling and dispensing automatic. Some of these proposals have included an electrical control unit which is connected by electrical wires or cable to the pipet gun, and which is provided with an electronic key pad for selecting a pipet operating mode from several such modes pre-programmed into the control unit, and for entering certain information, e.g., as to the desired fill volume and the desired volume of the aliquots to be dispensed. However, such systems require the use of electrical wires between the control unit and the pipet gun and these wires make the pipet gun less easily moved when reaching to a position for drawing in liquid, and when reaching to another position for dispensing the liquid, as well as creating possible electrical safety problems which might be caused by excessive flexing of the electrical wires as the pipet gun is being used.

BRIEF SUMMARY OF THE INVENTION

The present invention comprises a 5 programmable pipet gun apparatus which solves the problems of the prior art by providing apparatus for automatically filling a pipet tube to a desired fill volume, and then automatically dispensing desired uniform aliquots of liquid from the pipet tube, without the operator having the burden of concentrating on the graduated markings on the pipet tube to see that the tube is filled to the desired fill volume, and to see that the desired volume of each aliquot is successively dispensed from the pipet tube.

It is also an object of this invention to provide pipet gun apparatus which is programmable to automatically fill and automatically dispense, but does not have electrical wires extending from the programming apparatus to the pipet gun. Instead, the pipet gun is connected to the programming apparatus by four flexible air hoses. One flexible hose extends from the up valve button of the pipet gun, a second flexible hose extends from the down valve button of the pipet gun, and a third flexible hose extends from a mode valve selection button of the pipet gun which selects the mode of operation. The fourth flexible hose extends from a syringe in the control apparatus to a connector in the pipet gun which is connected to the top of a pipet tube.

DETAILED DESCRIPTION

Figure 1:
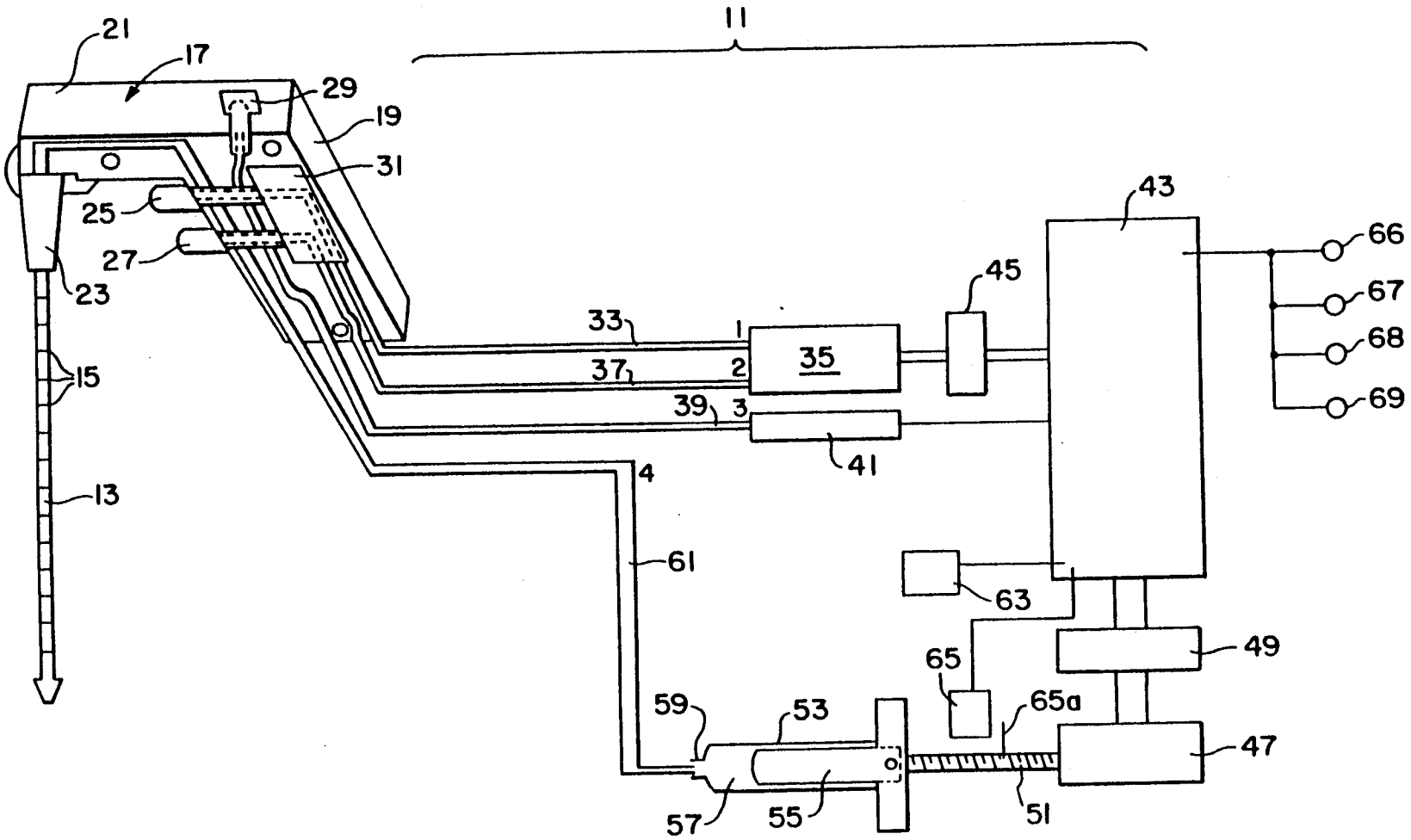
FIG. 1 is a diagrammatic view of the pipet gun and the programmable apparatus for controlling the automatic operation of the pipet gun.

Turning to the drawings, there is shown in FIG. 1 a programmable pipet gun apparatus 11 for programming the filling of a pipet tube 13 to a desired volume of liquid which would be indicated by the calibrated markings 15 on the pipet tube 13, and for programming the dispensing of desired aliquots of the liquid, to speedily feed the wells in a tray with a uniform aliquot or volume of liquid. For example, a desired fill volume may be 20 ml and a desired dispensing aliquot may be 1 ml, so that the dispenses 20 aliquots of 1 ml, with 1 aliquot of liquid or media going into each well in the tray.

Since in accordance with the invention, the fill volume is drawn into the pipet tube automatically, and the dispensing aliquots are dispensed automatically, this feeding of the cells is accomplished speedily and automatically and without the operator having to concentrate his eye on the fill volume markings and on the aliquot volume markings on the pipet tube.

The programmable pipet gun apparatus 11 comprises a pipet gun 17 which has a handle 19 and a barrel 21 that has a connector 23 for connecting to the top of pipet tube 13. The pipet gun 17 is adapted for connection to pipet tubes made by many manufacturers.

Pipet gun 17 also has an up valve button 25 which is pressed to draw liquid into pipet tube 13, a down valve button 27 which is pressed for dispensing liquid from the pipet tube 13, and a mode valve button 29 for selecting the mode of operation of the pipet gun apparatus 11 from among the four modes available: manual, programmable up, programmable down, and automatic.

Up valve button 25 and down valve button 27 are supported in handle 19 by a valve housing 31.

Up valve button 25 is connected by a flexible air hose 33 to an air pressure sensor transducer 35 which is at a remote location and which senses the air pressure signal transmitted from the up valve button 25 and transmits a corresponding electrical signal to a microcontroller 43.

Down valve button 27 is connected by a flexible air hose 37 to the air pressure sensor transducer 35 which senses the air pressure signal transmitted from the down valve button 27 and transmits a corresponding electrical signal to the microcontroller 43.

Mode selection valve button 29 is connected by a flexible air hose 39 to an air switch 41 which closes an electrical circuit in response to the pressing of valve button 29 and transmits an electrical signal to the microcontroller 43.

Microcontroller 43 has means for receiving the electrical signals from the pressure sensor transducer 35 that correspond to the pneumatic signals from the up valve button 25 and from the down valve button 27, and also for receiving electrical signals from the air switch 41 that correspond to the pneumatic signals from the mode valve button 29.

An analog to digital converter 45 is positioned in the electrical circuit between pressure sensor transducer 35 and microcontroller 43.

The electrical output of controller 43 is connected to a stepping motor 47 by a motor driver 49, and the motor 47 is provided with a threaded shaft 51 which is moved linearly by the motor 47 in response to signals from the microcontroller 43.

A syringe 53 is provided and has a piston 55 enclosed within a cylinder 57 that has an air port 59 located at the top of the cylinder away from piston 55.

The piston 55 is mounted on the end of the threaded motor shaft 51 and is moved by it linearly. Piston 55 moves downwardly away from port 59 to create suction and draw liquid into the pipet tube 13, and moves upwardly toward port 59 to create a dispensing pressure in the pipet tube 13. This drawing suction and dispensing pressure are communicated from cylinder 57 to pipet gun 17 by a flexible air hose 61 which connects the cylinder port 59 to the pipet gun 17 and its pipet tube connector 23 to draw liquid into the pipet tube by creating a drawing suction, and to dispense liquid from the pipet tube by creating a dispensing pressure.

An on-off switch 63 is connected to the microcontroller 43 for turning the apparatus 11 on and off. The microcontroller 43 contains means for directing the moving of the piston 55 to a home position in response to the turning on of the switch 63. The home position of piston 55 is at the top of the cylinder 57 near the port 59. The microcontroller 43 also contains a counter that is moved to zero when the apparatus 11 is in home position.

After piston 55 is in home position, the operator starts to program the desired fill volume and the desired dispensing aliquot volume into the apparatus 11. To do so, he presses the mode valve button 29 to place apparatus 11 in programmable up mode of operation, and presses the up button 25 to draw liquid into pipet tube 13 and releases the button 25 when the liquid has reached its desired fill volume. Then he presses the mode valve button 29 to signal the microprocessor to place this information in its memory and to switch the apparatus 11 to the programmable down mode.

The memory n the microcontroller 43 records the fill volume of liquid drawn into the pipet tube 13 in response to signals from the up valve button 25 when it is pressed while in the programmable up mode for drawing liquid into the pipet tube 13.

The down button 27 is pushed to dispense a desired aliquot of liquid and the button 27 is released when the aliquot has been dispensed. Microcontroller 43 contains means for recording in its memory the volume of the aliquot of liquid dispensed between the pushing of the down valve button 27 and the releasing of the down valve button 27 while it is in the programmable down mode, and the mode valve button 29 is pressed to signal the microcontroller 43 to store the information, and to switch modes to automatic mode. Microcontroller 43 contains means for switching the apparatus 11 to the automatic mode in response to this push of the mode valve button 29, and thereafter provides for automatic fill of liquid into pipet tube 13, and automatic dispensing of the aliquots from the pipet tube 13.

In the automatic mode the pipet tube 13 is automatically filled to the desired fill upon pressing the up valve but on 25, and desired aliquots are automatically dispensed from the pipet tube 13 by successively pressing the down valve button 27. The desired aliquot is automatically dispensed each time the down valve button 27 is pressed and held until the aliquot leaves the pipet tube 13.

The operator may dispense less than the volume of the automatic aliquot if he desires to do so by releasing the down valve button 27 before the full aliquot volume has been dispensed. He may then dispense the remainder of the aliquot volume by again pressing the down valve button 27.

An opto isolator 65 is connected to the microcontroller 43 for signalling the controller 43 when the piston 55 is in home position. Opto isolator 65 is provided with an aluminum finger **65*a* that rides with shaft 51 and breaks the beam of the opto isolator 65 when the piston 55 is in home position, and the isolator 65 signals this information to the microcontroller 43**.

In operation, the method of automatically filling a pipet tube 13 with a desired fill of liquid and automatically dispensing desired aliquots of the liquid successively into wells in a tray or the like, comprises the steps of providing a programmable pipet apparatus 11 having a microcontroller 43 with means for receiving signals from an up valve button 25, from a down valve button 27, and from a mode of operation button 29. The buttons are mounted in pipet gun 17 which is connected to a pipet tube 13 by a connector 23. The microcontroller 43 contains means for sending signals to direct the operation of a motor 47 and the linear movement of its threaded shaft 51 which controls the linear movement of the piston 55 in syringe 53 that is connected to the pipet gun 17 and the pipet tube 13. The microcontroller 43, in response to pressing the up button 25, controls suction signals sent from the syringe to the pipet gun 17. Also, the microcontroller 43, in response to pressing the down button 27, controls the dispensing pressure signals sent from syringe 53 to pipet gun 17.

The programmable pipet gun apparatus 11 is turned on by turning on the on-off switch 63 connected to the microcontroller 43 which sets the piston 55 at home position at the top of cylinder 57 near port 59 and dispenses all liquid from the pipet tube 13. The apparatus 11 is in manual mode, and the lamp 66 is lit to indicate this condition.

The operator presses the mode button 29 to put the apparatus 11 in programmable up mode and turn on second lamp 67 and darken manual mode lamp 66.

The operator then presses the up valve button 25 to draw liquid into the pipet tube 13 and to signal the microcontroller the volume of liquid being drawn into pipet tube 13 and at what speed it is being drawn into the tube 13.

The operator releases the valve button 25 when the volume in the pipet tube 13 has reached a desired fill volume, and presses the mode button 29 to signal the microcontroller the volume of the fill which is recorded in its memory.

The push of the mode button 29 also signals the microcontroller to switch to the programmable down mode of operation, turns on programmable down lamp 68, and darkens programmable up lamp 67.

The operator then pushes the down valve button 27 to dispense a desired aliquot of liquid from the pipet tube 13, and he releases the down valve button 27 when he sees by looking at the markings on pipet tube 13 that the desired aliquot has been dispensed.

He then presses the mode button 29 again to record the volume of the desired aliquot in the memory of the microprocessor 43 so that the apparatus thereafter dispenses the desired aliquot when the apparatus 11 is in the automatic mode. This pressing of the mode button also places the apparatus 11 into the automatic mode, lights automatic mode lamp 69, and darkens programmable down lamp 68.

The apparatus 11 is now in automatic mode, and the operator successively presses the down valve button 27 to successively dispense measured aliquots of liquid automatically from the pipet tube into a series of wells in a tray or the like.

This method, of automatically filling a pipet tube 13 with a desired fill of liquid and automatically dispensing desired aliquots of liquid successively, may also be described as comprising the steps of providing a syringe 53 having a piston 55 in a cylinder 57 with the top of the cylinder 57 connected to the top of a pipet tube 13 by a flexible tube 61, moving the piston 55 to its home position at the top of its travel in the cylinder 57 near port 59 and thereby dispensing any liquid from the pipet tube 13, signalling the controller 43 that the piston 55 is in its home position and recording that information in the memory of the controller 43, drawing liquid into the pipet tube 13 to a desired fill volume, signalling the controller 43 that the desired fill volume has been reached and recording that fill volume in the memory of the controller 43, dispensing a desired aliquot of liquid from the pipet tube 13, signalling the controller 43 that a desired aliquot has been dispensed from the pipet tube 13 and recording the size of the dispensed aliquot in the memory of the controller 43, automatically dispensing successive aliquots of liquid from the pipet tube 13, automatically refilling the pipet tube 13 to the desired fill volume by pressing the up button 25, and automatically dispensing successive aliquots of liquid from the pipet tube 13 by pressing down button 27.

Microcontroller 43 also sends signals to a series of four lamps 66–69 which are LED's which glow to indicate the mode of operation that apparatus 11 is in, with lamp 66 indicating manual operation, lamp 67 indicating programmed-up operation, lamp 68 indicating programmed-down operation, and lamp 69 indicating automatic operation.

Pipet gun 17 is preferably a Pipet-Aid pipet gun sold by Drummond Scientific Company, Broomall, Pa.

Figure 2:
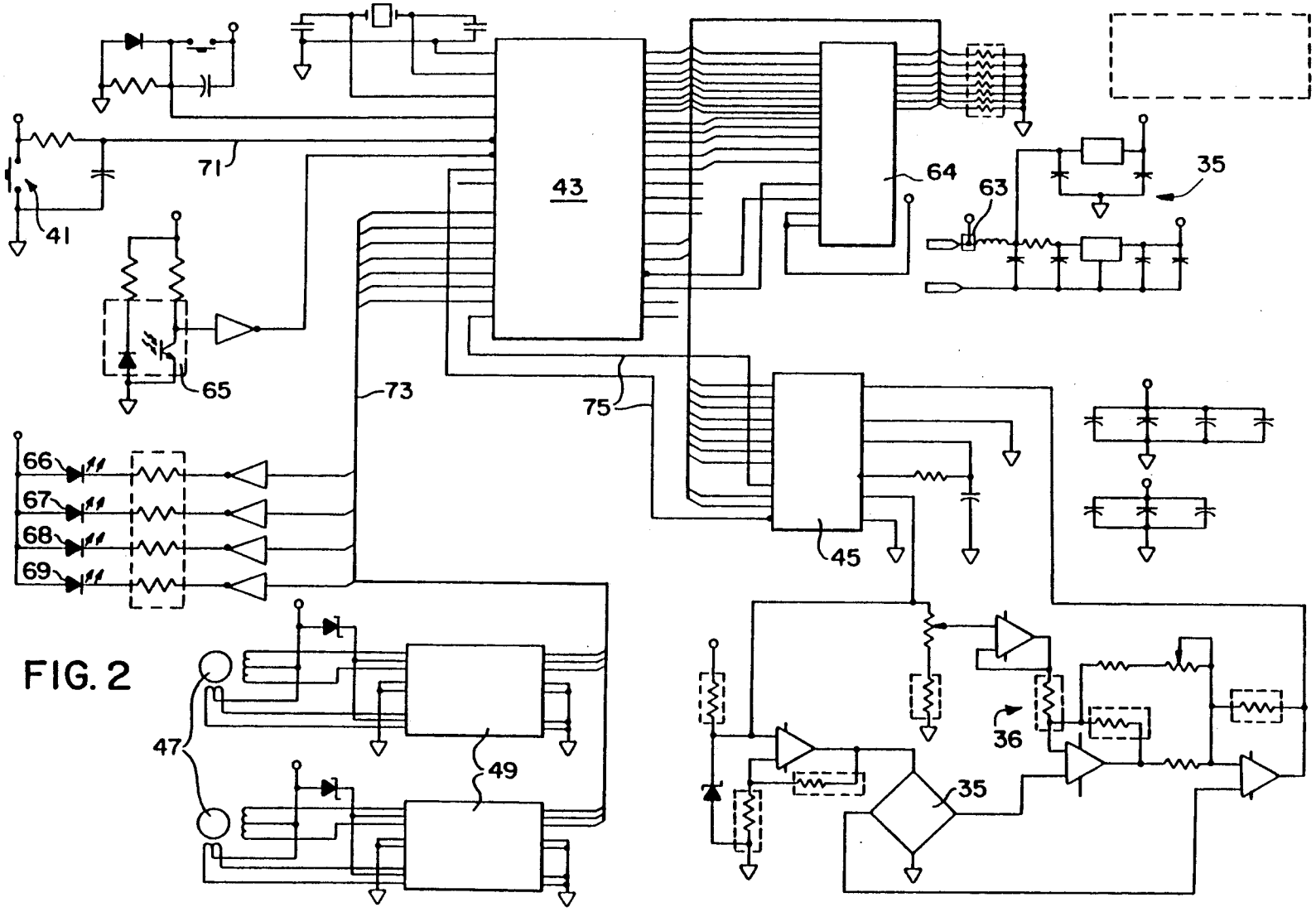
FIG. 2 is a drawing showing the electrical circuit of the programmable apparatus of FIG. 1.

Turning now to the circuit diagram shown in FIG. 2, there is shown microcontroller 43 and the various elements of apparatus 11 that are connected to the microcontroller 43. Microcontroller 43 is an 80C31 from the 8051 family of microcontrollers made by Intel, though it may be made by others, and its program memory 64 is an 87C64 EPROM.

The program memory 64 stores a program which comprises a set of instructions for the microcontroller 43. For example, those instructions might tell the microcontroller 43 that when the on-off switch 63 is turned on, turn the motor 47 on, in the up direction, until the opto isolator 65 sees the finger 65*a* to indicate that the apparatus 11 is in home position. So, when the on-off switch 65 is turned on, the microcontroller 43 asks the programmed memory 64 for instructions as to what to do, and receives the instructions to turn the motor 47 on and run the piston 55 in the up direction to dispense any liquid in the pipet tube until you get a signal from the opto isolator 65 that indicates that the finger 65*a* and the apparatus 11 are in home position. The microcontroller 43 reads the instructions from the programmed memory 64 and carries them out.

The microcontroller 43 has a memory, called a static memory, which counts, say, 15 pulses during the program up mode to record the fill volume in its memory. Thereafter, when the apparatus 11 is in the automatic mode and the operator wishes to fill the pipet tube 13 to fill volume, the programmed memory 64 tells the microcontroller 43 that if the volume counter in the controller 43 is registering a different number from the fill volume number in your memory, move the motor 43 until the volume count in the pipet tube equals the fill volume count in your memory.

Apparatus 11 has two memories: a program memory 64, and a static memory which is located in controller 43.

When the apparatus 11 is in home position, the controller 43 asks the program memory 64 for instructions, and the program memory 64 tells the controller 43 to go into manual mode. The microcontroller 43 does so, and turns on manual mode lamp 66, and waits for the next instruction from the program memory 64. The next instruction is to wait for a button to be pushed on pipet gun 17. If the mode button 29 is pushed, that signal goes to the microcontroller 43 which is instructed by the program memory 64 to go to the programmed up mode of operation.

The memory in the microcontroller 43 remembers the fill volume and the dispensing aliquot volume, and those memories are erased when apparatus 11 is turned off. But the memory in the program memory 64 is never erased, and is not lost when apparatus 11 is turned off. The program remains in memory 64 and is ready for use when the apparatus 11 is next turned on.

Mode switch 41 is an MPL-502 by Micro Pneumatic Logic Inc., Fort Lauderdale, Fla., and is connected to microcontroller 43 by electrical conductors 71.

LED's 66–69, which indicate the mode of operation when lighted, are connected to microcontroller 43 by electrical conductors 73.

Pressure sensor transducer 35 is Catalog No. 16 PC by Honeywell, and is connected to microcontroller 43 through analog to digital converter 45, which is ADC 0804 by National Semiconductor, Santa Clara, Calif., and electrical conductors 75.

Microcontroller 43 is connected by electrical conductors 73 to motor drivers 49, which is a UCN5804B but may also be a UCN4204B by Sprague Electric Company, Worcester, Mass., and motors 47, which may be 92211-P2 by Airpax Corp., Cheshire, Conn.

ADVANTAGES

It is well to note that all of the operations of apparatus 11 are performed in the handle 19 by pneumatics. There are no electrical wires to the handle 19. Electrical wires are stiff and could impede the flexible use of the pipet gun 17, and could also raise a possible electrical hazard.

Others have marketed an electronic device for programming the drawing of liquid into a pipet tube and then dispensing it. One such device has an electronic portion with a motor and piston in the handle of the pipet gun and wires going from the pipet gun back to an electronic box. There is also an electronic key pad to enter the data into the apparatus, such as fill volume of 10 milliliters, and dispensing aliquots of 0.5 milliliter, which gives the operator of the device 20 shots.

In the present programmable pipet gun apparatus 11, the operator programs in his fill volume and his dispensing aliquots from observing the markings on the pipet tube itself, and does not have to use key pads and does not have to insert numerical information.

In the present invention, a totally pneumatic handle and pipet gun 17 controls an electronic programming device.

In the present invention, the operator, after turning the apparatus 11 on and moving into home position, draws a liquid media into the pipet tube 13 by pressing the up valve button 25 to send a pneumatic signal to a pressure sensor transducer 35 that is translated into an electrical signal which goes to microcontroller 43 which sends an electrical signal to motor driver 49 to rotate the motor 47 and to lower the piston 55 in its cylinder 57 which creates a suction to draw liquid into the pipet tube 13. When the liquid reaches a desired height of, say, 10 milliliters, the operator releases button 25, tells the microcomputer 43 that the pipet tube 13 is filled to the desired volume, and switches apparatus 11 into programmable down mode, by pressing mode valve switch 29 which sends an air impulse signal to the air switch 41.

The operator then dispenses an aliquot of liquid, say one-half milliliter, by pressing the down button 27 and releasing it when he sees that. one-half milliliter has been dispensed. He then tells the microcomputer 43 that the desired automatic aliquot is one-half milliliter by pushing the mode button 29, which is recorded in the microcontroller memory. This push on the mode button 29 also switches the mode to automatic and lights lamp 69. Switch 41 signals the microcontroller that the liquid has reached fill volume and the volume is recorded in the microcontroller's memory, and the microcontroller is switched into the programmable down mode of operation. The operator then automatically discharges preselected portions or aliquots of one-half milliliter of the liquid or media successively into wells by pressing the down valve button 27 until he sees that the aliquot has been dispensed. Even though he holds the down valve button 27 in pressed position after the aliquot has been dispensed, no more liquid is dispensed until he releases the button 27 and presses it again to dispense the next aliquot. The operator then pushes the down button 27 successively to automatically discharge aliquots of one-half milliliter of media until he entirely discharges the total fill volume of 10 milliliters.

The aliquots are controlled as to volume by the microcontroller which controls the stepping motor 47, and identical aliquots of media are discharged from the pipet tube 13 by pressing the down button 27 of a pipet gun 17 which is totally pneumatic but controls an electronic microprocessor and an electric motor and associated electronic circuits that control the syringe 53. The amount of intake volume and the discharge aliquot is controlled initially by the eye of the operator who observes the markings on the pipet tube. Apparatus 11 does not use an electronic key pad with numerical input, which may lead to error if the numerical input does not coincide with the markings on the pipet tube 13, and does not use electric wires connected to its pipet gun 17, and does not have electrical elements in the pipet gun 17.

The method used to determine the speed control and mode of Drummond's programmable apparatus 11 is derived by measuring the differential air pressure between the two buttons 25 and 27 and looking for air pressure from a third button 29 located in the pipet gun 17.

The pipet gun 17 contains four air hoses 33, 37, 39 and 61. Hose number 39 is connected to the housing of mode valve button 29 which contains a piston. When the piston is pushed down, it produces a small air pressure against pressure switch 41 which sends an electrical signal to the microcontroller 43. This signal determines the mod of operation of the dispenser apparatus 11. The piston of mode valve button 29 is located in the top of the handle.

The two pistons in buttons 25, 27 in the handle 19 of pipet gun 17 send small air pressure through their corresponding hoses 33, 37. These hoses 33, 37 are connected to a pressure sensor transducer 35 that determines the differential pressure between each air hose 33, 37. The sensor transducer 35 in turn sends an electrical signal to the analog to digital converter 45. The converter 45 sends a digital signal to the microcontroller 43 that: 1) determines which button 25, 27 was pushed; and 2) determines how fast the motor 47 should run.

The microcontroller 43 then sends pulses to the motor 47 to correspond to the direction the operator wishes and the speed which he desires.

The motor 47 drives a piston 55 which is connected to hose 61. This hose 61 goes from the end 59 of the syringe 53 to the nose piece or connector 23 located in the pipet gun 17.

I claim:

1. A method of automatically filling a pipet tube with a desired fill of liquid and automatically dispensing desired aliquots of liquid successively into the wells of a tray, comprising the steps of providing a programmable pipet apparatus having a microcontroller with means for receiving signals from an up valve button means for drawing liquid into the pipet tube, a down valve button means for dispensing liquid from the pipet tube, and a mode of operation button means for selecting the mode of operation of the pipet apparatus, all of said button means being positioned in a pipet gun which draws liquid into and dispenses it from a pipet tube, said microcontroller having means for sending signals to direct the operation of a motor and its threaded shaft which has a linear movement that controls the linear movement of a piston in a syringe, the syringe being connected to the pipet gun and the linear position of the piston controlling the pressure and suction signals sent from the syringe to the pipet gun and the pipet tube, turning on the programmable pipet apparatus by turning on an on-off switch connected to the apparatus and setting the piston at home position and dispensing all liquid from any pipet tube connected to the pipet gun and placing the apparatus in manual mode, pushing down the up valve button means to draw liquid into the pipet tube and to signal the microcontroller the volume of liquid being drawn in and at what speed, releasing the up valve button means when the volume in the pipet tube has reached a desired fill volume, pushing the mode button means to signal the microcontroller to switch to a programmable down mode of operation, signalling the microcontroller that the fill volume has been reached, recording the fill volume in the memory of the microcontroller, pushing the down valve button means to dispense liquid from the pipet tube, releasing the down valve button means when the desired aliquot has been dispensed from the pipet tube, pressing the mode button means to record the volume of the desired aliquot in the memory of the microprocessor so that the apparatus is in automatic desired aliquot when the apparatus is in autómatic mode, and also to place the apparatus in automatic mode, successively pressing the down valve button means to successively automatically dispense aliquots of liquid from the pipet tube into a series of wells in a tray, pressing the up valve button means to automatically draw in liquid to the fill position, and successively pressing the down valve button means to successively automatically dispense aliquots of liquid from the pipet tube.

2. A method of automatically filling a pipet tube with a desired fill of liquid and automatically dispensing desired aliquots of liquid successively into wells in a tray, comprising the steps of providing a syringe having a piston in a cylinder with the top of the cylinder connected to the top of a pipet tube by a flexible hose, moving the piston to its home position at the top of its travel in the cylinder and dispensing any liquid from the pipet tube, signalling a controller that the piston is in its home position and recording that information in the memory of the controller, drawing liquid into the pipet tube to a desired fill volume, signalling the controller that the desired fill volume has been reached and recording that fill volume in the memory of the controller, dispensing a desired aliquot of liquid from the pipet tube, signalling the controller that a desired aliquot has been dispensed from the pipet tube and recording the size of the dispensed aliquot in the memory of the controller, automatically dispensing successive aliquots of liquid from the pipet tube, automatically filling the pipet tube to the desired fill volume, and automatically dispensing successive aliquots of liquid from the pipet tube.

* * * * *